US006709573B2

(12) United States Patent
Smith

(10) Patent No.: US 6,709,573 B2
(45) Date of Patent: Mar. 23, 2004

(54) PROCESS FOR THE RECOVERY OF HYDROCARBON FRACTIONS FROM HYDROCARBONACEOUS SOLIDS

(76) Inventor: Anthon L. Smith, 388 N. 780 East, Lindon, UT (US) 84042

( * ) Notice: Subject to any disclaimer, the term of this patent is extended or adjusted under 35 U.S.C. 154(b) by 0 days.

(21) Appl. No.: 10/194,993

(22) Filed: Jul. 12, 2002

(65) Prior Publication Data

US 2004/0007507 A1 Jan. 15, 2004

(51) Int. Cl.[7] ..... C10G 1/00

(52) U.S. Cl. ..... 208/390; 208/408; 208/428; 208/433; 208/434; 201/30; 423/352

(58) Field of Search ..... 208/390, 408, 208/428, 433, 434; 201/30; 423/352, 359, 248, 246, 354

(56) References Cited

U.S. PATENT DOCUMENTS

| | | | | |
|---|---|---|---|---|
| 3,496,094 A | | 2/1970 | Smith | |
| 3,617,471 A | * | 11/1971 | Schlinger et al. | 208/11 |
| 3,617,472 A | * | 11/1971 | Schlinger et al. | 208/11 |
| 3,764,547 A | * | 10/1973 | Schlinger et al. | 252/184 |
| 4,003,821 A | | 1/1977 | Weil et al. | |
| 4,133,741 A | | 1/1979 | Weichman et al. | |
| 4,148,358 A | | 4/1979 | Compton | |
| 4,197,281 A | * | 4/1980 | Muenger et al. | 423/359 |
| 4,213,954 A | * | 7/1980 | Pinto | 423/359 |
| 4,261,856 A | | 4/1981 | McMinn, Jr. | |
| 4,264,567 A | * | 4/1981 | Pinto | 423/359 |
| 4,277,416 A | * | 7/1981 | Grant | 518/703 |
| 4,296,085 A | * | 10/1981 | Banquy | 423/359 |
| 4,297,201 A | | 10/1981 | Jones et al. | |
| 4,412,909 A | | 11/1983 | Faulkner et al. | |
| 4,502,942 A | | 3/1985 | Lee et al. | |
| 4,534,849 A | | 8/1985 | Edwards | |
| 4,585,543 A | | 4/1986 | Duncan et al. | |
| 4,587,006 A | | 5/1986 | Minden | |
| 4,725,350 A | | 2/1988 | Smith | |
| 4,731,386 A | | 3/1988 | Onsager | |
| 4,869,887 A | | 9/1989 | Van Dijk | |
| 4,900,429 A | * | 2/1990 | Richardson | 208/418 |
| 4,938,783 A | * | 7/1990 | Ranke et al. | 48/197 R |
| 5,008,005 A | | 4/1991 | Shang | |
| 5,180,570 A | | 1/1993 | Lee et al. | |
| 5,384,335 A | | 1/1995 | Tierney et al. | |
| 5,681,452 A | | 10/1997 | Kirkbride | |
| 5,865,023 A | * | 2/1999 | Sorensen et al. | 60/39.02 |
| 6,248,794 B1 | | 6/2001 | Gieskes | |
| 6,319,395 B1 | | 11/2001 | Kirkbride et al. | |

* cited by examiner

*Primary Examiner*—Walter D. Griffin
(74) *Attorney, Agent, or Firm*—Thorpe North & Western, LLP

(57) ABSTRACT

Process and apparatus for extraction of oil and hydrocarbons from crushed hydrocarbonaceous solids, such as oil shale, involving the pyrolyzing of the crushed solids with liquid hydrocarbon and syn gas rich in hydrogen and carbon dioxide. Crushed hydrocarbonaceous solids are treated with liquid hydrocarbon and hot syn gas at an elevated temperature in a rotary kiln where the crushed solids are cascaded into the hot syn gas for sufficient time to strip the volatile liquids and gases found in the solids, removing the vaporized liquids, enriched syn gas and spent crushed solids from the kiln, fractionating the vaporized liquids and enriched syn gas into the desired fractions. The enriched syn gas is particularly suited for use in combined-cycle electricity generation and in the preparation of various by-products. The process efficiently recycles heat and energy to reduce harmful atmospheric emissions and reliance on external energy sources.

23 Claims, 4 Drawing Sheets

PROCESS FOR THE RECOVERY OF HYDROCARBON FRACTIONS FROM HYDROCARBONACEOUS SOLIDS

BACKGROUND OF THE INVENTION

1. Field of the Invention

This invention is related to the recovery of hydrocarbons from solid carbonaceous materials, and more specifically to an improved process using syn gas and liquid hydrocarbon in a generally horizontal rotary kiln.

2. Background

Worldwide demand for hydrocarbons and related petrochemicals and fertilizers is increasing at a rapid annual rate. Crude petroleum and natural gas are basic in satisfying these demands while at the same time many industries have experienced shortages despite the discovery of new oil and gas sources. Therefore, alternate solid hydrocarbon sources and feed stocks, such as coal, tar sands, oil shale and solid crudes present an ever increasingly attractive source for meeting demand for hydrocarbon products.

Oil shale and tar sands, also known as oil sands and bituminous sands, arc particularly promising sources of these needed products as large deposits are found in Canada and the United States. The largest known deposit of oil shale is the Green River formation in Utah, Colorado and Wyoming with about a third of such deposits in the state of Utah. The hydrocarbon resource locked in the Green River formation has been estimated to be in excess of 1.5 trillion barrels. This is a considerable resource considering known world oil shale reserves amount to just over 2.5 trillion barrels, by conservative estimates.

The demand for hydrocarbon resources makes development of the Green River formation virtually certain. During the 1970s and 1980s several oil shale operations were developed in Colorado and Utah, however due primarily to economic considerations most of these operations have since ceased. An average recovery of about 29 to 34 gallons of oil per ton of oil shale was typical of these previous recovery efforts.

Green River oil shale is a pctroliferous material (heavy viscous oil material) which is as high as 25% by weight with an average of 12% by weight hydrocarbon. The recovered oil is about 17°–25° API gravity, frequently averaging about 21°, and contains a low amount of sulfur and low aromaticity. The Green River shale has relatively high moisture content of between about 0.4% to 6%. Ranges for analysis of several samples of Green River oil shale are shown in Table 1. The balance of the components, not shown in the table, are made up primarily of various minerals and trace metals.

TABLE 1

| Components | Green River Oil Shale (wt %) |
|---|---|
| Carbon | 9.1–19.6 |
| Organic Carbon | 6.7–15.7 |
| Hydrogen | 1.1–2.0 |
| Nitrogen | 0.2–0.7 |
| Sulfur | 0.9–3.4 |
| Fisher Assay | |
| Oil | 3.4–11.6 |
| Water | 0.4–5.9 |

TABLE 1-continued

| Components | Green River Oil Shale (wt %) |
|---|---|
| Residue | 83.4–91.0 |
| Gas liquor | 0.8–3.3 |
| Gas and loss | 2.1–4.1 |

The largest known deposits of tar sands are the Athabasca sands found in northern Alberta, Canada which underlay more than 13,000 square miles at a depth up to 2,000 ft. Of the 24 states in the United States that contain tar sands, about 90% of such deposits are in the state of Utah. The hydrocarbon resource locked in the Utah tar sands has been estimated to be in excess of 25 billion barrels.

However, the Utah tar sands, being of non-marine origin, have somewhat different chemical and physical characteristics than the Athabascan sands which are of marine origin, and do not respond as well to the traditional process used to extract oil from tar sands. Utah tar sands are generally hard consolidated sand stone closely associated with pctroliferous material (heavy viscous oil material) which is as high as 13% by weight with an average of 10.5% by weight hydrocarbon. The oil is about 13°–18° API gravity and contains a low amount of sulfur, e.g. less than about 0.9% by weight, low aromaticity and a very low water content. The Athabascan sand has an encapsulating water film surrounding each sand grain, which makes it amenable to a water-wetting process. The absence of this water film on the Utah sand grain necessitates using other technology for extracting the oils.

A comparison of the Athabascan tar sands with a sample of Utah tar sands obtained from Asphalt Ridge is shown in Table 2.

TABLE 2

| Components | Athabasca Sands | Asphalt Ridge Sands |
|---|---|---|
| Carbon (wt-%) | 82.6 | 84.4 |
| Hydrogen (wt-%) | 10.3 | 11.0 |
| Nitrogen (wt-%) | .47 | 1.0 |
| Sulfur (wt-%) | 4.86 | .75 |
| Oxygen (wt-%) | 1.8 | 3.3 |
| Average Mol. Wt (VPO-benzene) | 568 | 820 |
| Viscosity (poise) 77° F. (cone-plate at 0.05 sec) | 6,380 | 325,000 |
| Volatile material (535° C.) (wt-%) | 60.4 | 49.9 |

The high viscosity, low sulfur content, low water content and other significant differences keep the Utah tar sands from responding well to commonly used extraction processes.

A number of oil recovery methods related to oil shale and tar sands have been tested in the laboratory or in small operations in the field. These processes involve various techniques such as hot water processes, cold water processes, solvent processes, thermal processes and the like, but in most eases, they possess certain limitations which make them unsuitable for use on a commercial basis. Further, many of these processes leave over 20% of the organic carbon behind in the spent shale. A process which would be effective with these particular oil shales and tar sands would be a significant advance in the art.

It is an object of the invention, therefore, to provide a new and efficient process for the extraction of hydrocarbonaceous material from solids containing such material and particularly from Green River oil shale. Another object of the present invention is to provide unique synergies to facilitate the economical production of various products from hydrocarbonaceous solids. It is a further object to provide such an extraction process which could utilize equipment now in commercial use, meet present day EPA standards and could be rapidly put into commercial production to meet the urgent demand for various hydrocarbon products.

SUMMARY OF THE INVENTION

It has now been discovered that these and other objects can be accomplished by the process of the present invention which relates to a new and improved process for extracting oil and other valuable hydrocarbons from crushed hydrocarbonaceous solids, such as oil shale, by means of a thermal technique using a special source of heat. The process of the present invention represents an improvement upon U.S. Pat. No. 4,725,350, hereby incorporated by reference in its entirety, and which is also the work of the present inventor.

Specifically, the present invention provides a new and efficient process for extracting valuable oils and other hydrocarbons from crushed hydrocarbonaceous solids which comprises blending the crushed solids to provide a substantially uniform feed composition and preheating the crushed hydrocarbonaceous solids to remove residual water. The crushed solids are treated in a generally horizontal rotary kiln having a slight slope downward with hot syn gas containing hydrogen and carbon dioxide at an elevated temperature and sprayed liquid hydrocarbon in the absence of water. The pressure inside the kiln is maintained below 30 psi and the crushed solids are cascaded into the hot syn gas for sufficient time to strip volatile hydrocarbon containing liquids and gases found in the crushed solids. The hydrocarbon rich vaporized materials, enriched syn gas and spent solids are removed from the kiln and the gaseous products are fractionated into desired fractions.

In a more detailed aspect of the present invention the hot syn gas is introduced into the rotary kiln at a temperature between 1000° F. and 2500° F. and the crushed solids are preheated to a temperature between 100° F. and 350° F. to reduce the heating load on the kiln.

In yet a more detailed aspect of the invention the hot syn gas is the product of coal gasification. Further, the enriched syn gas may be used as a starting material for the manufacture of other products such as methanol, ammonia, urea and natural gas or combusted and utilized in a combined-cycle electricity generation step to supplement the heating ad, power needs of the process.

The new process presents distinct advantages over the known processes for extraction of hydrocarbons from oil shale, and is particularly adapted for use in the treatment of oil shale and tar sands obtained from Utah deposits. Particular advantage is found in the fact that Utah oil shale is located near large deposits of coal and facilitating a unique combination of the two techniques of coal gasification and the utilization of the syn gas therefrom directly in the oil shale extraction process. In addition, the use of the special hydrogen and carbon dioxide-containing hot gas effects an upgrading of the products as to yield and quality, e.g. 5 to 25% increase in yield of light ends, e.g. gasoline and lighter fractions, and thus presents a desirable economic advantage. As used herein, all percents are by weight unless specifically identified otherwise. The enriched syn gas has a variety of potential uses, all of which increase the economic and practical utility of the process of the present invention. Among these uses are the production of methanol, ammonia, urea, natural gas and recoverable heat value. Further, gas produced in the process may be used for the production of electricity in a combined-cycle power generation step. This reduces the need for off-site electrical power and minimizes burning so as to reduce atmospheric emissions of harmful gases to well below EPA standards.

Further, no water is present in the reaction zone as any residual water is removed during the preheat stage. This has many advantages, such as lower heat requirement during the reaction in the rotary kiln, as well as improved yield. Furthermore, there would be no need for building expensive dams and other water collection projects prior to the operation of the process. In addition, the process utilizes equipment now in commercial production and does not require specially produced equipment which may require long periods of time for construction.

Finally the process presents an additional economic advantage in that the oil vaporized off the oil shale will be in vapor form and can be sent directly to a fractionating tower for refining, thereby eliminating the expense of reheating the hydrocarbons for fractionation.

Additional features and advantages of the invention will be apparent from the detailed description which follows, taken in conjunction with the accompanying drawings, which together illustrate, by way of example, features of the invention.

DETAILED DESCRIPTION OF THE INVENTION

While the process of the invention is described hereinafter with particular reference to the processing of oil shale using specific language to describe the same, it will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention. For example, it will be apparent that the process can also be used to treat a great variety of hydrocarbon-containing solids, such as tar sands, solid crude oil, gilsonite, peat, and mixtures of two or more of these materials, or any other hydrocarbon-containing solids with inert materials.

Process Overview

The following overview is designed to provide a brief synopsis of the process of the present invention, while the particulars of each step will be discussed in greater detail below. Hydrocarbonaceous solids are treated to recover valuable hydrocarbon fractions. The process of the present invention provides several additional advantages which increase the economic value of the process. Several of these advantages include the production of a synthetic gas which can be used to produce a variety of industrial chemicals and may be used in the production of electricity to supplement various energy requirements of the process.

Figure 1:
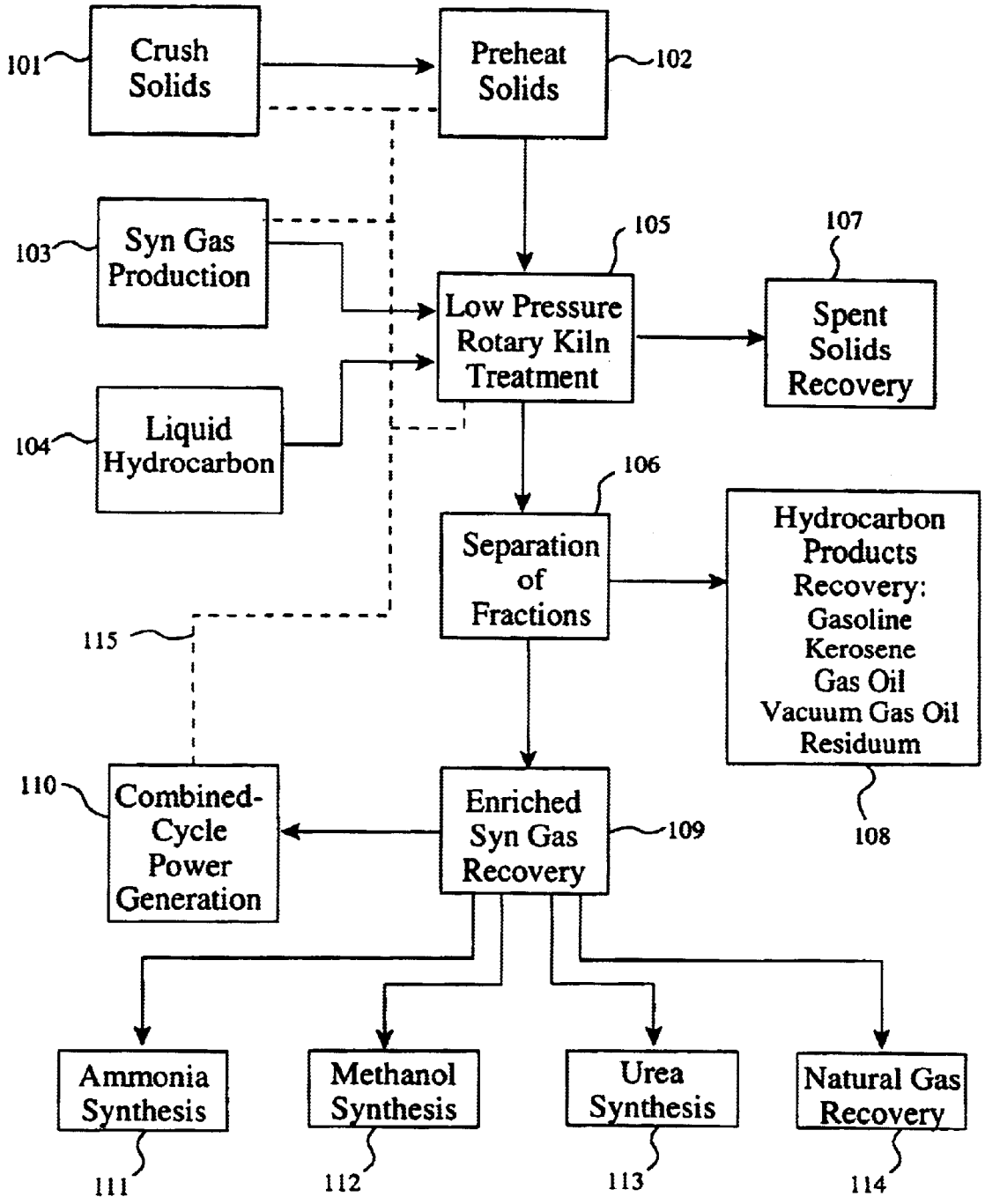
FIG. 1 is a flow diagram of the process of the present invention.

Referring now to FIG. 1, hydrocarbonaceous solids are crushed at step 101 and then preheated at step 102. The crushed solids are then treated in a low-pressure rotary kiln at step 105 where substantially all of the volatile hydrocarbons are removed. The rotary kiln treatment includes the presence of an atmosphere containing both hydrogen and carbon dioxide at an elevated temperature and will be discussed in more detail below in connection with FIGS. 2, 4 and 5. This unique atmosphere is commonly provided using a hot syn gas produced from a coal gasification step 103, shown in FIG. 1. Further, a liquid hydrocarbon is provided in step 104 during the rotary kiln treatment step 105 to improve yields of hydrocarbon products. The rotary kiln treatment of the crushed solids results in the production of vaporized hydrocarbons, an enriched (i.e. modified) syn gas, and a quantity of spent solids. The spent solids are recovered from the kiln in step 107. The vaporized hydrocarbons and enriched syn gas are separated in step 106. The vaporized hydrocarbons are then fractionated in step 108 into desired hydrocarbon fractions for further refining or sale. The enriched syn gas is recovered in step 109 and further used in one or more of several ways. The enriched syn gas contains sufficient heat and BTU value to drive an appropriately designed combined-cycle power generation in step 110 to provide electrical energy to other parts of the process, as depicted by dashed line 115. The enriched syn gas may also be used in the production of various industrial chemicals as shown in step 111 for ammonia synthesis, step 112 for methanol synthesis, step 113 for urea synthesis, and step 114 for the, recovery of natural gas. Each of these steps are discussed in more detail below in conjunction with the accompanying figures.

Hydrocarbonaceous Solids Preparation

Referring now to FIG. 1, hydrocarbonaceous solids are crushed at step 101 to increase the exposed surface area and to improve the ultimate hydrocarbon recovery. As noted above, the hydrocarbonaceous solids used in the process of the invention may be any solid material having hydrocarbons dispersed within or on the solids. Most often the solids contain at least 8% and preferably 10% to 70% by-weight of hydrocarbon materials. Such hydrocarbonaceous material includes, but is not limited to, oil shale, tar sands, crude oil, gilsonite, peat and mixtures thereof. The hydrocarbonaceous material contained within oil shale has an average content of: Carbon (wt %) 70–90%, Hydrogen 7 to 15%, Nitrogen 0.5 to 3%, and Sulfur 0.2 to 4%. The average content of bitumen in tar sands is: Carbon (wt %) 70–90%, Hydrogen 7 to 15%, Nitrogen 0.3 to 3%, Sulfur 0.5 to 8%, and Oxygen 1 to 6%. Crushed tar sands containing over about 15% bitumen tend to agglomerate and may cause processing difficulties. Crushed oil shale, however, contains kerogen and does not generally agglomerate during processing according to the present invention. Kerogen is a high molecular weight hydrocarbon having an average carbon to hydrogen weight ratio of between about 7/1 and 8/1.

The above-described solid materials are crushed into small particles before further processing. The target particle size is less than about 1 inch and ranges from about 0.1 to about 1 inch. Particle sizes below about 0.1 inches are undesirable as the particles become entrained in the exit gases. Although, some entrainment of solid particles is acceptable, down-stream processes may be adversely affected. Particle sizes between about 0.25 and 0.75 inches give good results under a variety of conditions.

Due to the nature of many mined materials, the composition of incoming feed may vary considerably over time. Such variations often cause undesirable shifts in the required thermal load, rate of recovery, and fractionation parameters. The composition of the hydrocarbonaceous material may vary over a wide range and depends upon the type and geographic origin of the material. Further, hydrocarbonaceous solid deposits vary in composition from the same source. In order to reduce this variation, it is often desirable to blend the hydrocarbonaceous materials either before or after crushing. This is most often accomplished by stockpiling the materials horizontally and then taking vertical cuts as feed to the process.

Preheat

According to FIG. 1, the crushed solid materials are then preheated at step 102 before introduction into the rotary kiln. Preheating serves at least two beneficial purposes. First, preheating the crushed solids decreases the thermal requirements later in the process. Second, and more importantly, preheating drives off excess moisture. The presence of significant amounts of water later in the process may cause undesirable gas shift reactions and other difficulties. In the particular embodiment shown in FIG. 2, the crushed hydrocarbonaceous solids, such as crushed oil shale, are preheated in vessel 10, and taken to hopper 11 through line 17. Vessel 10 may be any unit capable of heating the crushed solid materials to the desired temperatures such as a rotary kiln, furnace or other heat transfer equipment. Preheat temperatures may vary over a wide range depending upon the material being treated and the temperature of other materials used in the reaction kiln. Preheating preferably provides the maximum amount of heat without vaporizing significant amounts of hydrocarbons. Temperatures ranging from about 100° F. to about 350° F. accomplish this purpose while temperatures from about 200° F. to 350° F. provide good results.

The preheating can be accomplished before being introduced into the hopper or while being maintained in the hopper. Conventional heating equipment may be used for this purpose. BTUs obtained from other portions of the process may also be a suitable source of heat for the preheating step. Spent solids recovered at the end of the process, heat from coal gasification, or heat produced from combustion of various products are several non-limiting examples of heat sources which could be used to reduce the requirement of extra-process energy. As shown in FIG. 1, the preheated crushed solids are then treated in a horizontal rotary kiln, discussed in more detail below.

Syn gas Preparation

Figure 2:
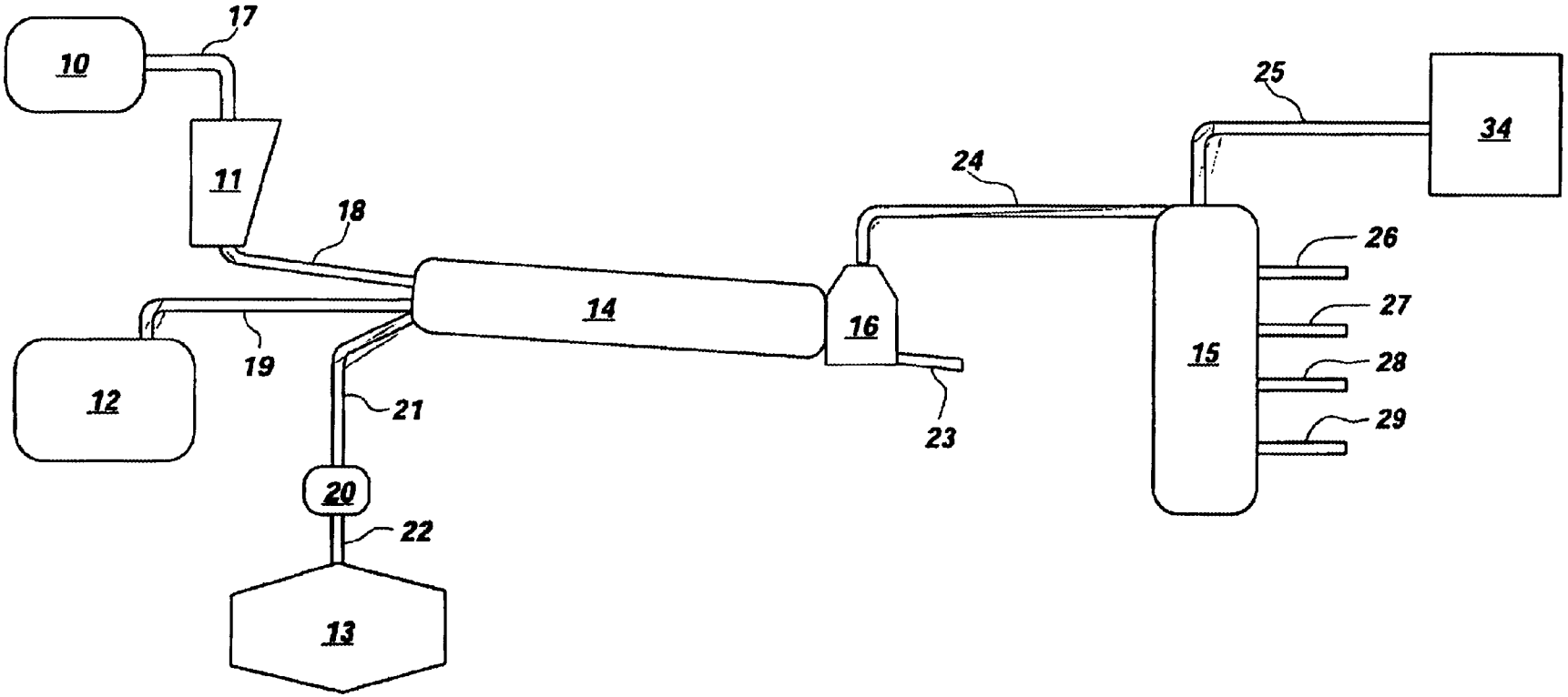
FIG. 2 is a schematic diagram of one embodiment of the apparatus and flow path for carrying out a portion of the process of the present invention.

An important feature of the present invention is providing a hot gas containing hydrogen and carbon dioxide in step 103, as shown in FIG. 1. As shown in FIG. 2, hot gas containing hydrogen and carbon dioxide is delivered to the rotary kiln 14 via line 21. The hot gas containing hydrogen and carbon dioxide to be used in the process of the present invention can be obtained from any suitable source. The gas employed in the process should contain between about 25% and 60% hydrogen, and preferably 30% to 40%, and between about 10% and 20% carbon dioxide. The hot gas should be at an elevated temperature above 1000° F., while temperatures from 1000° F. to 3000° F. are particularly useful.

Coming under special consideration is hot gas containing from 25% to 40% hydrogen and from 10% to 20% carbon dioxide at a temperature of 1500° F. to 2500° F. Such hot synthesis gas, i.e. syn gas, may be economically provided from the gasification of coal. One coal gasification process which would suffice for purposes of the present invention is described in Oil and Gas Journal, Jun. 19, 1972, page 26 as the Koppers-Totzek process. Although a variety of improvements have been made to the process the basic gasification process remains the same. According to that process, a mixture of steam and oxygen entrains the pulverized coal and gasifies it in the gasifier or combustion chamber 13, shown in FIG. 2, producing a high temperature gas at about 3500° F. The coal used in the production of the syn gas can be obtained from any suitable source, e.g., can contain large or small amounts of sulfur and variable heat content. A variety of coals can be used such as lignite, bituminous coal, sub-bituminous coal, anthracite coal, and brown coal. Lignites and bituminous coals are not only readily available but also provide good results. Initial pulverization of the coal dramatically increases the coal surface area and improves both the rate of reaction and syn gas yields. The coal particle size is often selected so that about 70% of the solid coal feed can pass through a 200 mesh sieve.

In general, the gasification process is carried out by partially combusting the pulverized coal with a limited volume of oxygen at a temperature between about 1500° F. and 3600° F. If a temperature of between about 1900° F. and 3600° F. is employed, the syn gas produced will contain minimal by-products such as tars, phenols, condensable hydrocarbons, molten slag particles and salts. The gasification process is usually carried out in the presence of oxygen and steam, wherein the purity of the oxygen is at least 90% by volume, with nitrogen, carbon dioxide and argon being permissible impurities. Some coals contain significant amounts of water which may require drying before gasification. The reaction conditions within the gasifier are maintained by the regulation of the weight ratio of the oxygen to moisture and ash free coal in the range of 0.6 to 1.0, or the range 0.8 to 0.9. Specific details of the equipment and procedures employed are known to those skilled in the art and are described in various sources such as U.S. Pat. No. 4,350,103 and U.S. Pat. No. 4,963,162. The ratio between oxygen and steam may be selected so that from 0.0 to 1.0 parts by volume of steam is present per part by volume of oxygen. The oxygen used may also be heated before contact with the pulverized coal. Although not necessary the oxygen may be provided at temperatures from about 380° F. to 950° F. The conditions within the gasifier may also vary widely. The gasifier pressure may vary from about 1 to 200 atm (absolute), with relatively low pressures of up to 40 atm usually being sufficient, and residence times may vary from about 0.1 to 15 seconds.

After the pulverized coal, oxygen, and steam have been reacted, the reaction products, which comprise hydrogen, carbon monoxide, carbon dioxide, water and various impurities, are removed from the gasifier. This product stream, which normally has a temperature between 1500° F. and 3200° F., contains the impurities mentioned and entrained slag, including various carbon-containing solids. In order to facilitate removal of these solids and impurities from the gas, the reaction product stream should be first quenched and cooled.

The gas that is produced from coal gasification is essentially carbon monoxide, hydrogen and carbon dioxide with a relatively small percentage of nitrogen, hydrogen sulfide, carbonyl sulfide, and traces of other compounds. This hot syn gas generally contains between about 25% and 40% hydrogen, between about 40% and 60% carbon monoxide, and between about 10% and 20% carbon dioxide. In addition, more than 50% of the ash solids drop down through a quench and is eliminated in gas stream. A coal gasifier for example, using 3,400 tons of coal a day will produce over 364 million cu. ft. of 800 BTU/SCF gas daily. This would be sufficient to produce approximately 50,000 barrels of oil a day according to the method of the present invention.

An advantage of using syn gas from coal gasification is the presence of significant amounts of both hydrogen and carbon dioxide. As mentioned before, the hydrogen atmosphere aids in cracking and pyrolysis of the hydrocarbons while the presence of carbon dioxide further enhances the yield of hydrocarbons. Thus, by carrying out the process of the present invention in an atmosphere containing substantial amounts of both hydrogen and carbon dioxide improved results are obtained.

Another advantage of using hot syn gas from the gasification of coal by the Koppers-Totzek process is found in the fact that this technique produces large amounts of nitrogen in the oxygen step and this can be further reacted with enriched syn gas from the present process to produce valuable anhydrous ammonia as a by-product, described in more detail below. Production of ammonia in this manner appears more reliable than producing ammonia from natural gas.

Referring to FIG. 2, the hot gases leaving the gasifier 13 have a temperature of at least about 2,750° F. The desired temperature of the hot syn gas to be introduced into the rotary kiln 14 will vary depending upon the product being treated in the kiln, preheat temperature of the crushed solids and residence time in the rotary kiln. In most cases, the desired temperature of the syn gas upon entry to the kiln will vary from about 1,000° F. to 2,500° F. This may necessitate cooling of the hot syn gas before introduction into the rotary kiln. The cooling can be accomplished by any suitable means, but is preferably accomplished by use of an optional conventional heat exchanger 20 as shown in FIG. 2. The hot syn gas from the gasifier 13 is taken through line 22 to a heat exchanger 20 where it is brought to the desired temperature. The recovered heat value may be optionally transferred to other parts of the process such as the preheater 10 or used to produce steam for electricity generation, discussed in more detail below.

Liquid Hydrocarbon

Figure 4:
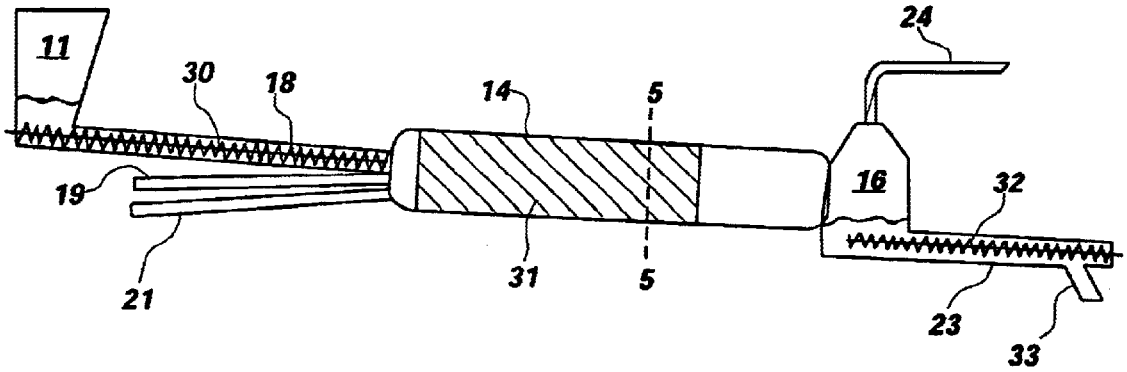
FIG. 4 is a longitudinal cross-sectional view of a rotary kiln in accordance with the present invention.

A liquid hydrocarbon, such as crude oil or hydrocarbon product condensates, is also delivered to the rotary kiln 14. The liquid hydrocarbon may be delivered from a container 12 via line 19 at any point in the kiln 14 or added to the crushed solids prior to entry into the kiln. For example, in FIG. 4, the liquid hydrocarbon could be sprayed onto the crushed solids along the screw conveyor 30 or through line 19 and sprayed into the kiln at any point. Thus, although both FIG. 2 and FIG. 4 show line 19 connecting at the entry end of the rotary kiln other configurations are within the scope of the present invention. The sprayed hydrocarbon need not be heated, but the entry temperature will have an affect on the heat load of the kiln. The rate of delivery of liquid hydrocarbon depends largely on the properties of the crushed solids and the desired product. Thus, the delivery rate of liquid hydrocarbons may range from about 5 to 50 gallons per ton of crushed solids, while about 10 to 20 gallons per ton should work well for most feedstock. The addition of the liquid hydrocarbon increases the rate of recovery and vaporization of the volatiles contained on the crushed solids. Further, addition of a liquid hydrocarbon, such as crude oil, has the benefit of increasing the yields of various hydrocarbon fractions and offers an inexpensive method for separating various hydrocarbon fractions from the crude oil.

Horizontal Rotary Kiln

Referring now to FIG. 4, the crushed solids are brought to rotary kiln 14 through line 18. Line 18 may contain a screw conveyor 30, weir or other similar device for facilitating delivery of the crushed solids to the kiln. Hot syn gas is delivered to the rotary kiln through line 21, most often as a product of coal gasification. The point of entry of line 21 being such that the crushed solids from line 18 entering the kiln cascade over the hot syn gas and preferably at a point such that the particles cascade down over the hot syn gas being introduced at a lower point in the kiln. The liquid hydrocarbon is most often introduced via line 19 in close proximity to the point of entry of the crushed solids. Spraying of the liquid hydrocarbon results in improved contact and increased surface area for heating and interacting with the crushed solids and the hydrocarbon materials contained thereon. The crushed solids, hot syn gas and liquid hydrocarbon flow co-currently through the length of the kiln. As these materials pass through the kiln the temperature of the crushed solids increases resulting in vaporization of a substantial portion of the volatile hydrocarbonaceous material originally contained in and on the crushed solids.

The rate of rotation of the kiln is adjusted as needed to bring about the desired separation and volatilization of the hydrocarbonaceous material. The use of the rotary kiln as described above permits the use of particles having a moderately fine particle size such as those that might be present in the solid materials of the type found in oil shale deposits, although extremely fine particles may become entrained in the gas and necessitate additional scrubbing to remove before fractionation. One also employs a very low pressure in the rotary kiln which will vary over a narrow range, e.g. 5 psi to 30 psi. Pressures from 5 psi to about 10 psi have generally provided satisfactory results. Although catalysts need not be employed in the process of the present invention to obtain the desired results, in some cases it may be desirable to accelerate the production of certain products or improve pyrolysis to employ catalytic materials in the rotary kiln. Such catalysts are commercially available and some common examples include nickel, vanadium, and various heterogeneous catalysts.

As the temperature employed in the kiln is important, it is necessary to maintain proper preheat temperature, syn gas temperature and liquid hydrocarbon temperature to produce the needed temperature in the kiln. Shown below in Table 3, is an illustration of the relationship of preheat temperature and syn gas temperature to bring about the desired kiln temperature.

TABLE 3

| RUN No. | BARRELS/ DAY OIL | PRE-HEAT° F. | SYN GAS TEMP ° F. | TEMPERATURE IN KILN |
|---|---|---|---|---|
| 1 | 10,000 | 250 | 1,800 | 700 |
| 2 | 10000 | 350 | 2,500 | 572 |
| 3 | 3,670 | 350 | 2,500 | 900 |
| 4 | 1,380 | 60 | 1,800 | 900 |

The parameters are adjusted so that the temperature in the kiln is between 600° F. and 1,000° F. with temperatures between 700° F. and 900° F. giving particularly good results.

As shown in FIGS. 2 and 4, the kiln is in a substantially horizontal position with a slight slope and is rotated at a rate sufficient to maintain the desired residence time. Although a slope of up to about 8° could work in the present invention, typically about 3°–5° slope provides adequate residence time within the rotary kiln. The required residence time in the kiln will also vary depending upon the type of solid being treated, particle size, rate of addition, syn gas temperature, liquid hydrocarbon temperature, and rate of rotation of the kiln. Typically, a kiln load of less than 35% and preferably less than about 15% offers adequate mixing and heating conditions. These parameters should be adjusted so that the particles remain in the kiln until they are substantially stripped of the hydrocarbonaceous material contained therein. Obviously, the crushed solids, hot syn gas and average kiln temperature will exhibit a temperature gradient throughout the length of the rotary kiln. For example, entry temperatures of 2400° F. for the syn gas, 350° F. for the crushed solids, 100° F. for the liquid hydrocarbon, and 1600° F. for the refractory the temperature of each will converge toward an average temperature of about 1100° F. toward the outlet end of the rotary kiln. Thus, the various hydrocarbons contained on the crushed solids are gradually heated to their respective boiling points and/or pyrolysis temperature.

According to the method of the present invention, between about 88% and 99% of the hydrocarbonaceous material in the original crushed solids is recovered. In most cases, the solids leaving the kiln should have no more than 1 or 2% of hydrocarbonaceous material remaining on the solid particles. At a syn gas temperature of about 1000° F. to 2500° F., a crude oil temperature of about 50° F. to 150° F., a crushed solids entry temperature of 350° F., and particle size of about 0.75 inch of oil shale, a residence time of about 10 to 20 minutes should be sufficient to effect the necessary separation. At 10% load and a residence time of about 12 minutes, the rate of rotation of the rotary kiln is between 2 and 5 rpm.

These parameters are also controlled so as to minimize the secondary decomposition of the valuable hydrocarbon material to form coke and other undesirable by-products. This can be accomplished in most cases by the use of lower temperatures and shorter reaction periods. It should be noted here that the hydrogen atmosphere has several advantages. As the hydrocarbon material is vaporized and continues to heat, a portion of the material will pyrolyze and crack to form smaller hydrocarbon chains. As long as temperatures are controlled to avoid excessive coke formation this improves the quality,and value of the hydrocarbon fractions ultimately recovered. Hydrogen will react with vapors deficient in hydrogen to form more light ends for removal at the fractionation step. The presence of the hydrogen atmosphere brings about a 5% to 25% increase in yield of light end products as compared to the conventional thermal process using hot gas free of hydrogen. Further, the hydrogen atmosphere prevents excessive undesirable secondary decomposition and production of aromatics, toxic off-gases and coke. Under hydrogen-deficient conditions pyrolysis is inefficient and a greater amount of char or coke is produced decreasing the yield of useful hydrocarbons. The hydrogen not only facilitates removal of the hydrocarbons imbedded in the particles, but much of the sulfur present in the crushed solids will be picked up by the hydrogen and may be carried to a sulfur removal unit. Additionally, the presence of a substantial amount of carbon dioxide has proven to positively affect the yields of hydrocarbons from Green River oil shale and Utah tar sands. Typically, a carbon dioxide content of between about 10% and 20% of the incoming hot syn gas provides the cited results.

Figure 5:
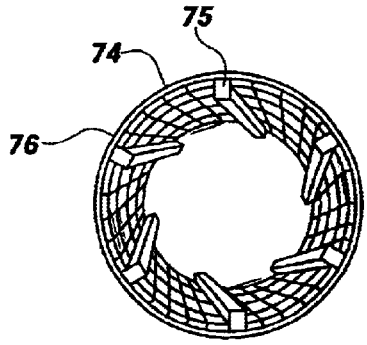
FIG. 5 is an axial cross-section view taken along line 5—5 of FIG. 4, showing a refractory configuration within the kiln.

Any substantially horizontal rotary kiln should suffice for the present invention. Various internal configurations are also possible. Referring to FIG. 4, the refractory 31 may be smooth walled or may contain longitudinal baffles to aid in mixing of the crushed solids. Although these embodiments are considered within the scope of the present invention it has been discovered that mixing is improved by using the following described refractory configuration. FIG. 5 illustrates an axial cross-sectional view taken along line 5—5 of FIG. 4, which shows a generally horizontal rotary kiln in accordance with one embodiment of the present invention. The rotary kiln 14 may be constructed of a steel shell 76 and lined with a refractory made up of firebrick 74 and 75. As shown in FIG. 5, the bricks are arranged so as to have certain bricks 75 set on end rather than flat 74 in a slightly offset pattern so as to present a series of spiraling baffles such as the lands in a rifle barrel. The baffles extend only about ¾ of the length of the kiln leaving the last quarter containing just the firebrick liner having bricks laid flat. As shown in FIG. 5, in a rotary kiln of about 6 feet in diameter, the baffles arc arranged so as to he about 2 to 4 feet apart. Thus, as the kiln rotates, the baffles cause the crushed particles to be agitated thereby improving exposure of each particle to the hot syn gas and other vapors resulting in increased rate of removal of hydrocarbons. Notice that the spiraling of the baffles permits a gradual shifting of the solid particles down through the kiln and affords maximum exposure of the hot syn gas and vapors to the particles. This spiraled configuration offers increased contact of the crushed solids with the hot syn gas and other vaporized materials over the configuration having no baffles or straight baffles which would lift up a portion of the crushed solids at intervals rather than continuously down the length of the baffling. Although other rotary kilns may be used, the removal of hydrocarbons is greatly facilitated by the construction of the rotary kiln as shown in FIGS. 4 and 5.

Product Removal

After the crushed solids travel the length of the rotary kiln, the resulting enriched syn gas, hydrocarbon containing vapors and spent solids are removed from the kiln. The enriched syn gas contains a portion of the original syn gas components, methane, particulates and other light components. As shown in FIG. 2, at the end of the residence period in the kiln, the hydrocarbon vapors, enriched syn gas and residual solids are discharged to a separation hopper 16 where the vapors and gas are separated from the spent solids. In the embodiment shown in FIG. 2 the enriched syn gas, vaporized hydrocarbons and spent solids are delivered to a separation hopper 16 where the vapors are discharged through line 24 to fractionation column 15 and the spent solids enter line 23. The solids are removed by means of a screw conveyor or other suitable means and taken to a disposal unit, or a unit where the BTUs can be removed via heat exchange and utilized in the preheating of the raw crushed solids to be introduced into the rotary kiln. In one embodiment shown in FIG. 4, line 23 contains a screw conveyor 32 and interconnects line 33 through which the solids are discharged. Only a small amount of coke is formed in the process of the invention. Such a small amount can be processed out and burned to generate steam or recycled to the coal gasification step.

The products taken from the kiln generally comprise 10–30% enriched syn gases, 5–25% volatilized condensates, 1–10% coke, and 60–85% spent solids. Product yield, excluding the spent solids, from various types of tar sands is illustrated in Table 4.

TABLE 4

| PRODUCT | ATH | TST | AR | PRS | WIL |
|---|---|---|---|---|---|
| Enriched Gases | 7.52 | 5.31 | 4.80 | 7.41 | 6.03 |
| Condensates | 76.52 | 72.82 | 82.85 | 76.05 | 77.04 |
| Coke | 15.90 | 21.87 | 12.35 | 16.54 | 16.93 |

Key: ATH-Athabasca Sands, TST-Tar Sand Triangle, AR-Asphalt Ridge, PRS-P. R. Spring, WIL-Wilmington.

Enriched syn gas analyzed by gas chromatography and mass spectrometry gave the results shown in Table 5 as to the Tar Sand Triangle run.

TABLE 5

| COMPOUND | Moles (%) Helium free basis |
|---|---|
| Hydrogen | 14.3 |
| Methane | 47.3 |
| Ethylene | 1.6 |
| Ethane | 10.9 |
| Propylene | 3.1 |
| Propane | 5.5 |
| 1,3-butadiene | 0.1 |
| Butenes | 2.6 |
| Iso-butane | 0.0 |
| n-Butane | 2.2 |
| Cyclopentane | 0.1 |
| Pentenes | 0.7 |
| Isopentenes | 0.3 |
| N-Pentane | 1.3 |
| Ammonia | 0.7 |
| Hydrogen sulfide | 5.0 |
| Carbon monoxide | 3.9 |
| Carbon dioxide | 0.4 |
| Total | 100.0 |

Typical analysis of the vaporized hydrocarbon is shown in Table 6 giving the carbon and ring analysis of condensates obtained from the Tar Sand Triangle run.

TABLE 6

| TYPE | ATOMIC % CARBON |
|---|---|
| Paraffinic carbon | 55–60 |
| Aromatic carbon | 18–20 |
| Naphthenic carbon (saturated) | 9–16 |
| Olefin carbon | 10–12 |
| Aromatic rings/molecule | 0.07 |
| Naphthenic-olefin ring molecules | 1.2 |

Separation of Gaseous Fractions

The gaseous products removed from the rotary kiln are separated in step 106 of FIG. 1 to produce both final products and precursors for further processing. Referring to FIG. 2, the vaporized hydrocarbons and enriched syn gas taken along line 24 may be taken to a cyclone (not shown) where any small fines are removed. The vaporized hydrocarbons and enriched syn gas are then delivered to a fractionation column 15 where they can be easily separated into the desired fractions. The enriched syn gas is removed via line 25 and taken to tank 34 while the various hydrocarbon fractions are taken off as desired via lines 26, 27, 28 and 29. The fractionation of the vaporized hydrocarbons, e.g. above-described condensates, can be accomplished by any suitable means. The present process presents a special advantage in that the hydrocarbon condensates to be separated are already at an elevated temperature, e.g. about 500° F. to 1200° F., and the fractionation process can be accomplished without having to raise the temperature of the condensates before introduction into the fractionation column. Suitable products from such fractionation include light distillates, such as gasoline, middle distillates, such as jet fuels, diesel fuel and heating oil, and the residual products, such as asphalts. A partial range of products that can be obtained from the condensates derived from the pyrolysis of oil shale and tar sands is shown in Table 7. Table 7 is merely one example of recovered hydrocarbon fractions, therefore the actual results in may vary considerably depending on the feedstock solids and the process conditions chosen.

TABLE 7

| Temperature (° F.) | Hydrocarbon Fraction | Wt % |
|---|---|---|
| $C+^5$–392 | Gasoline | 9.8 |
| 392–527 | Kerosene | 11.3 |
| 527–617 | Gas oil | 9.7 |
| 617–752 | Heavy gas oil | 17.7 |
| 752–995 | Vacuum gas oil | 32.6 |

The quantity of these components, and particularly those in the lighter oil range, are significantly improved by the presence of hydrogen and carbon dioxide in the treating gas as shown in the example below. Typical recovery of oil from oil shale is between about 30 and 36 gallons per ton of crushed oil shale, while average recovery of oil from tar sands is slightly lower at about 20 to 30 gallons per ton of crushed tar sands.

Additional Products

Figure 3:
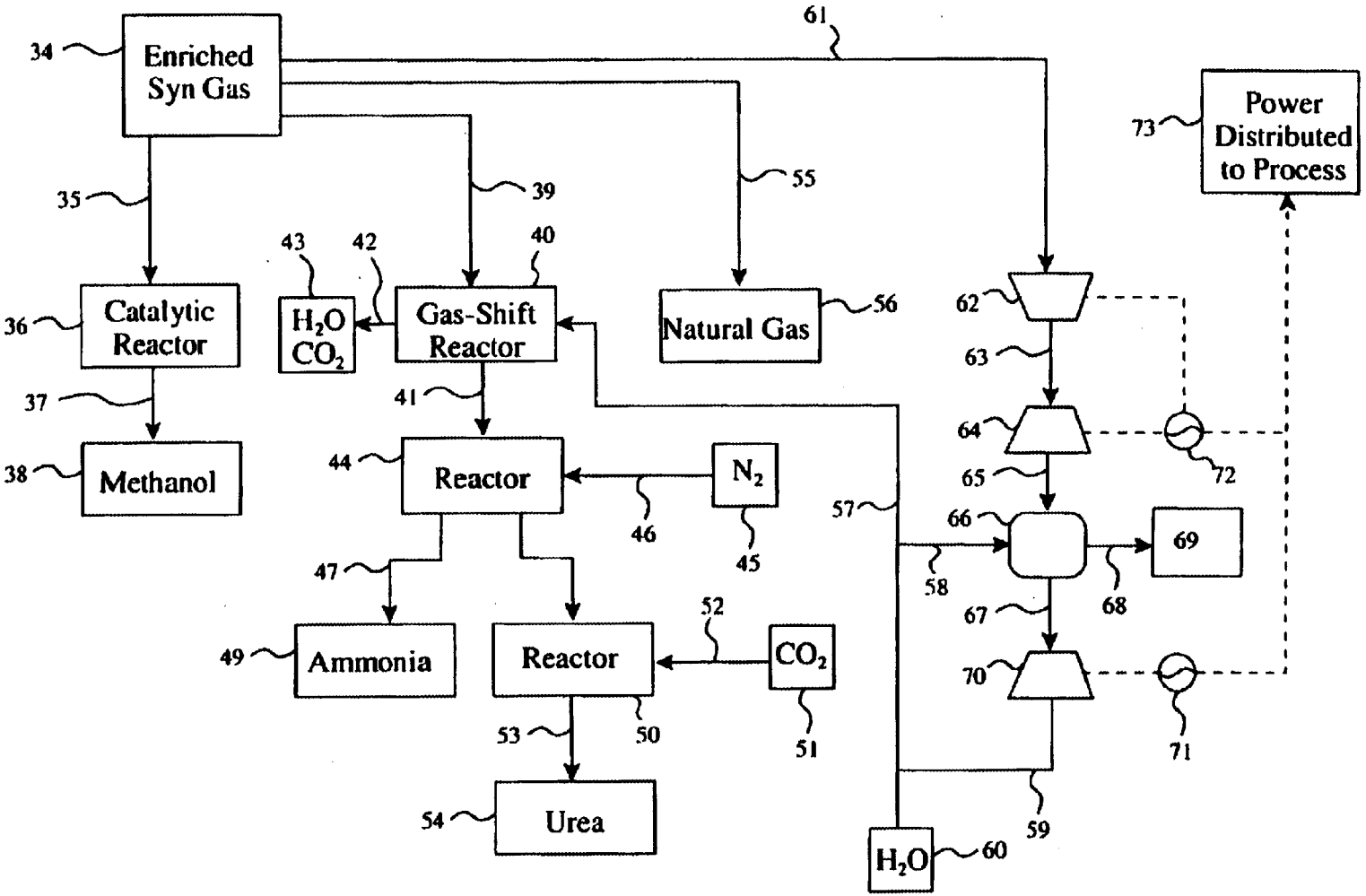
FIG. 3 is a schematic diagram showing the potential products and uses of the enriched syn gas.

In the embodiment shown in FIG. 2, the enriched syn gas removed from the top of fractionation column 15 through line 25 is taken to tank 34. This enriched syn gas contains various components which can be used in further reactions to form valuable by-products such as ammonia, methanol, urea, and natural gas, as shown in FIG. 1 in steps 111 through 114. Although, each individual process is known the unique integration of production according to the present invention provides increased energy efficiency and economic value. FIG. 3 shows a schematic view of the additional products and uses of the enriched syn gas and is an extension of FIG. 2 starting with the enriched syn gas tank 34.

Referring now to FIG. 3, one potential use of the enriched syn gas is to take a portion of the gas, which is rich in hydrogen, and combined it with nitrogen to form ammonia. Depending on the quality of the hydrogen stream, i.e. the enriched syn gas containing hydrogen and carbon monoxide, various purification steps such as catalytic water gas shift reactions may be necessary. In such a process, a portion of the enriched syn gas is taken along line 39 to gas-shift reactor 40. The hydrogen containing carbon monoxide is reacted in the gas-shift reactor with steam delivered via line 57. The steam is produced using any number of heat sources throughout the process, such as from the combined-cycle step discussed below. The carbon monoxide reacts with water to produce hydrogen and carbon dioxide. Thus, the carbon monoxide can be viewed as "potential" hydrogen, since the stoichiometric ratio in this reaction is 1:1 according to the following:

$$CO+H_2O \rightarrow CO_2+H_2$$

The excess water and carbon dioxide, along with any other impurities are then removed from gas-shift reactor 40 via line 42 to tank 43 and purified hydrogen is produced which is drawn from reactor 40 via line 41 and passed to reactor 44. At this point nitrogen is provided to reactor 44 via line 46 from source 45 (i.e. from the coal gasification step or an air separation process) to form liquid ammonia. The reactants are combined and react according to the equation:

$$3H_2+N_2 \rightarrow 2NH_3$$

This process is endothermic and may require some additional heating to drive the reaction toward the ammonia product which is taken to tank 49 via line 47 for further use or sale. Actual parameter determinations are easily made by those skilled in process design and reaction kinetics depending on the specific ammonia synthesis process chosen.

Another step in the process shown in FIG. 1 is the synthesis of methanol 112. Referring back to FIG. 3, a portion of the enriched syn gas is taken from tank 34 to a catalytic reactor 36 via line 35 for conversion to methanol which may be subjected to further conversion in steps, not shown, to products such as synthetic paraffins, gasoline additives, propane, 1000 BTU gas line, water, formaldehyde, chloromethanes, acetic acid, methyl acetate, methyl formate and the production various other intermediates or products. The predominant commercial source of methanol is currently from the reaction of syn gas containing hydrogen and carbon monoxide in the presence of a heterogeneous copper catalyst. Depending on the catalyst used, the methanol synthesis process may be a high or low-pressure process. Common catalysts for methanol synthesis using syn gas include, but are not limited to copper, zinc oxide, aluminum oxide, zinc, chromium oxide and mixtures thereof. The basic reaction is described by the following equation:

$$2H_2+CO \rightarrow CH_3OH$$

Moderate temperatures and pressures are generally required. For example, $Cu/ZnO$ and $Cu/ZnO/Al_2O_3$, catalysts are used at temperatures between 200° and 300° C. and 50 to 350 atm. Further, the stoichiometric ratio of hydrogen to carbon monoxide in common syn gas is well suited for this reaction with carbon monoxide acting as the limiting reagent. The resulting methanol is then taken from catalytic reactor 36 to tank 38 via line 37 from which it may be sold or used as a precursor for other commercial chemicals. Although yields and selectivity for methanol production vary widely, several processes have improved yields and selectivity to over 50%, and even over 90%.

A portion of the enriched syn gas may also be used to produce urea at step 113, as shown in FIG. 1. Ammonia produced according to the above-mentioned process or by other methods may be combined with carbon dioxide to produce urea. Referring to FIG. 3, ammonia is delivered via line 48 to a reactor 50 and combined with carbon dioxide delivered from source 51 via line 52. The carbon dioxide may be recovered from other parts of the process such as the gas-shift reactor 40 or another suitable source. The reaction produces urea, an amine, via an ammonium carbamate salt according to the following overall equation:

$$2NH_3+CO_2 \rightarrow H_2NCONH_2+H_2O$$

The reaction is carried out at moderate temperatures of about 250° F. and 400° F. and a pressure of between about 100 and 350 atm. The final urea product is removed from reactor 50 via line 53 to tank 54. The urea product is then used or sold and is most commonly used as a fertilizer.

In another aspect of the present invention the enriched syn gas may be further separated to produce natural gas in step 114, as shown in FIG. 1, for use as a fuel or otherwise sold. Referring to FIG. 3, a portion of the recovered enriched syn gas from tank 34 is taken via line 55 to unit 56. Notice that the enriched syn gas has a substantial quantity of methane and light hydrocarbons, as noted in Table 5. These light hydrocarbon fractions may be isolated using any number of separation technologies known in the art. The remaining components, predominantly hydrogen, carbon monoxide and a small amount of carbon dioxide, may be released or sent back to tank 34 and are ideally suited for the production of methanol, ammonia and/or urea according to the processes described above.

In another more detailed aspect of the present invention a portion of the enriched syn gas is removed for use as a fuel mixture which is burned and used to generate electricity in a combined cycle electricity generation step 110 of FIG. 1 for use in the process. The "enriched" syn gas is intended to emphasize that the original syn gas composition has not only changed slightly as a result of hydrogen and carbon dioxide reaction and depletion through the rotary kiln treatment step 105 but also because of the addition of light hydrocarbon fractions vaporized from the crushed solids which are lighter than gasoline, such as light alkanes and alkenes (see Table 5). This enriched syn gas has a heat value of about 400 to 500 BTU/SCF, which is sufficient to drive a combined cycle electricity generation process.

A simplified view of such a combined-cycle process is shown in FIG. 3. The enriched syn gas is delivered from tank 34 via line 61 to a gas turbine compressor 62 and compressed to about 100 to 500 psig and then burned to produce hot combustion gas between about 1500° and 3000° F. The hot combustion gas is directed via line 63 to a gas turbine 64 which drives a first generator 72. The electricity produced, shown as a dashed line in both FIGS. 1 and 3, can be used to drive the compressor 62 and/or used in other parts of the process, shown generally at point 73. The combustion gases exiting the gas turbine 64, usually at about 800° to 1500° F., are then directed to a heat exchanger 66. Heat exchanger 66 is supplied with water or steam via line 58 wherein a portion of the heat contained in the combustion gases from line 65 is transferred to produce a high-pressure steam between about 50 and 3000 psig and a temperature of about 250° to 1400° F. This high-pressure steam exits the heat exchanger via line 67 and the cooled combustion gases exit via line 68. The cooled combustion gases may then be stored in tank 69 or released, as the enriched syn gas is extraordinarily clean buming. The steam in line 67 is directed and expanded through a steam turbine 70 which drives a second generator 71 to produce additional electricity for distribution throughout the process. The expanded steam exits the steam turbine via line 59 and may be used for a variety of purposes. The steam may be recycled back to the heat exchanger along line 58 or to the gas-shift reactor 40 via line 57 discussed above or the remaining heat value can be recovered and used in other parts of the process, such as the preheat step 102 or preheating in the coal gasification step 103. The combined-cycle electricity generation is sufficient to provide the electrical needs of the entire process and any excess may be sold or stored.

Further, the spent solids recovered in step 107 of FIG. 1 at the end of the process will generally contain latent heat, coke and generally not more than 1 to 2% unrecovered hydrocarbon. The BTU units are preferably recycled to use in the preheating of the raw crushed solids at step 102 and the remaining spent solids are sold for use as cement feed or otherwise disposed of.

The description herein is designed to enable those skilled in the art to practice the method of the present invention and as such details well within the capacity of those skilled in the art will require some design and experimentation to determine exact operating parameters. Further, not all possible interconnections have been explained and diagrammed. For example, the water source 60 may be supplemented by water condensed from the gas-shift reactor off-gas tank 43 shown in FIG. 3, the drying/preheat step 102 shown in FIG. 1, the drying of pulverized coal, or from available make-up water sources.

EXAMPLE

The operation of the process of the invention is illustrated by the following example showing the use of hot syn gas obtained from the gasification of eastern coal and crude oil for the pyrolysis of Green River oil shale.

For the hot syn gas production step, 5,000 lbs. of eastern coal was dried to between 2% and 8% moisture and crushed to particle size of about 0.75 inch. The crushed coal was conveyed into a feed bin where it was continuously discharged into a mixed nozzle where it was entrained in oxygen and low-pressure steam. Moderate temperature and high burner velocity prevented the reaction of coal and oxygen before entry into the gasification zone. The oxygen, steam and coal reacted in the gasifier at a temperature of 3330° F. The carbon and volatile matter of the coal was gasified to produce a hot syn gas, and the coal ash converted into a molten slag. About 50–70% of this slag was dropped into a water quench tank and was carried from the tank to the disposal system as a granular solid, and the remainder is entrained in the gas exiting the gasifier. Gas leaving the gasifier was quenched to remove any entrained slag droplets and then passed through a heat exchanger to reduce the temperature to about 2100° F.

Green River Oil Shale was crushed to particle size of less than about 0.75 inch at 70° F. and passed into a preheater where it was preheated to a temperature of 350° F. and then taken by screw conveyor to a rotary kiln. The particles were cascaded over the hot syn gas at 2100° F. obtained from the coal gasification process described above. Further, crude oil at 80° F. was sprayed into the kiln at the entry point of the hot syn gas. The crushed solids outlet temperature was about 1000° F. and the outlet gas and vaporized materials temperature was about 1100° F. The kiln at a 5° slope was rotated at 5 rpm and a residence time of about 20 minutes. The vaporized hydrocarbons, enriched syn gas and spent solids were then passed to a separator hopper. The spent solids were removed at the bottom by screw conveyor and the vapors and gas taken to a cyclone where fine particles were removed and thence to the fractionation column. The data from this run is shown in Tables 8 and 9 below. The yields are calculated excluding the spent solids.

TABLE 8

| Properties | Value |
|---|---|
| Bitumen content of feed wt % | 12.2 |
| Oil Shale feed rate, lbs/hr | 5.0 |
| Kiln Average Temperature | 800° F. |
| Hydrocarbon yield, wt % | 69.2 |
| Enriched Gas yield, wt % | 20.6 |
| Coke yield, wt % | 10.2 |
| API Gravity of oil, 20° C. | 21.1° |

The vaporized hydrocarbon was then subjected to fractionation resulting in the hydrocarbon fraction yields as shown in Table 9.

TABLE 9

| Fraction | Wt % |
|---|---|
| Gasoline | 15 |
| Kerosene | 17 |
| Gas oil | 11 |
| Heavy gas oil | 18 |
| Vacuum gas oil | 24 |
| Residue | 15 |

The above process was repeated without the use of a gas containing hydrogen and carbon dioxide and resulted in much lower yield of light end products. As noted above, the presence of the hydrogen and carbon dioxide gives from 5% to 25% increase in the yield of the light end products.

Conclusion

The process of the invention can be operated on a batch, semi-continuous or continuous, manner and is ideally suited for large-scale continuous operation. A plant designed to handle 75,000 tons of shale a day would yield 50,000 barrels a day of oil, 1,440 tons of liquid ammonia by-products or the equivalent of 26,300 barrels of methanol, 63,000 tons of cement feed, and minimal off-gases.

The invention may be embodied in other specific forms without departing from the spirit or essential characteristics of the invention. The present embodiment is, therefore, to be considered in all respects as illustrative and not restrictive, the scope of the invention being indicated by the appended claims rather than by the foregoing description, and all changes that come within the meaning and range of equivalency of the claims are therefore to be embraced therein.

What is claimed is:

1. A thermal method for treating crushed hydrocarbonaceous solids to extract hydrocarbons therefrom comprising the steps of:

(a) blending the crushed hydrocarbonaceous solids to provide a substantially uniform feed composition;

(b) preheating the crushed hydrocarbonaceous solids to remove any residual water;

(c) treating the preheated crushed hydrocarbonaceous solids in a substantially horizontal rotary kiln having an upper end and a slight slope downward with (i) hot syn gas containing between about 25% and 60% by weight hydrogen and between about 10% and 20% by weight carbon dioxide at an elevated temperature and (ii) sprayed liquid hydrocarbon which vaporizes and mixes with the hot syn gas, in the absence of water, wherein pressure inside the kiln is below 30 psi and the crushed solids are introduced at the upper end of the sloped kiln and cascade into the hot syn gas for sufficient time to vaporize volatile components from the crushed solids to produce vaporized hydrocarbon materials, enriched syn gas and spent solids;

(d) removing the vaporized hydrocarbon materials, enriched syn gas and spent solids from the kiln; and (e) fractionating the vaporized hydrocarbon materials and enriched syn gas into desired fractions.

2. The method of claim 1, wherein hot syn gas containing hydrogen is introduced into the kiln at a temperature between 1000° F. and 2500° F.

3. The method of claim 1, wherein the crushed hydrocarbonaceous solids are preheated to a temperature between about 100° F. and 350° F. before being introduced into the kiln.

4. The method of claim 1, wherein the pressure in the kiln varies from about 5 psi to 15 psi.

5. The method of claim 1, wherein the crushed solids have a residence time in the kiln of from about 10 to 20 minutes.

6. The method of claim 1, wherein the liquid hydrocarbon is introduced into the kiln at a rate of between about 5 and 50 gallons of liquid hydrocarbon per ton of crushed hydrocarbonaceous solids.

7. The method of claim 6, wherein the liquid hydrocarbon is crude oil.

8. The method of claim 7, wherein the crushed hydrocarbonaceous solids is oil shale.

9. The method of claim 8, wherein the crude oil is introduced into the kiln at a rate of between about 30 and 50 gallons of crude oil per ton of crushed oil shale.

10. The method of claim 7, wherein the crushed hydrocarbonaceous solids are tar sands.

11. The method of claim 10, wherein the crude oil is introduced into the kiln at a rate of between about 20 and 25 gallons of crude oil per ton of crushed tar sands.

12. The method of claim 1, wherein the hot syn gas containing hydrogen is obtained from coal gasification.

13. The method of claim 1, further comprising the step of producing electricity in a combined cycle comprising:

(a) recovering the enriched syn gas for use as a fuel gas;

(b) combusting the fuel gas to produce a first heated gas which is directed to a gas turbine which is operatively connected to a first generator wherein the first heated gas is reduced in pressure through the gas turbine to produce a second heated gas; and (c) using the second heated gas to produce steam which is directed to a steam turbine which is operatively connected to a second generator.

14. The method of claim 1, further comprising the step of using the spent solids as cement feed after removing said spent solids from the kiln.

15. A process for thermal extraction of oil shale using hot syn gas containing hydrogen and carbon monoxide obtained from the gasification of coal which comprises:

(a) introducing crushed coal into a gasifier where it is reacted with oxygen and steam which yields a hot syn gas containing between 25% and 60% by weight hydrogen and between about 10% and 20% by weight carbon dioxide at a temperature of about 3000° F. to 3600° F.;

(b) removing the hot syn gas and cooling it to a temperature between about 1000° F. and 2500° F.;

(c) introducing liquid hydrocarbons and the cooled syn gas into a substantially horizontal rotary kiln sloping downward at an angle of between about 3 and 5 degrees where it is mixed, in the absence of water, with crushed oil shale which has been preheated to a temperature between 100° F. and 350° F., is introduced at an upper end of the sloped kiln, wherein the pressure inside the rotary kiln is below 15 psi and wherein the liquid hydrocarbon is sprayed into the kiln;

(d) maintaining the mixture in the rotary kiln for sufficient time to strip hydrocarbons from the oil shale leaving spent solids, producing an enriched syn gas and volatilized hydrocarbon material, (e) removing the volatilized hydrocarbon material, enriched gas and hot spent solids from the kiln;

(f) disposing of the hot spent solids; and (g) taking the volatilized hydrocarbon material and enriched gas to a fractionator where the material is separated into desired fractions.

16. The method of claim 15, wherein the oil shale is a Green River oil shale containing from 5% to 25% by weight of hydrocarbonaceous material.

17. The method of claim 15, wherein the oil shale is crushed into particles below about ¾ inch in size.

18. The method of claim 15, wherein the kiln is rotated at a rate of 1 to 10 rpm and the residence time is between 10 and 20 minutes.

19. The method of claim 15, wherein the volatilized hydrocarbon materials taken from the kiln comprises 5 to 10% enriched gas, 60 to 85% volatilized materials and 1 to 10% coke.

20. The method of claim 15, wherein the fractions include gasoline, kerosene, gas oil, heavy gas oil and vacuum oil.

21. The method of claim 15, wherein the enriched gas taken from the fractionator is passed through a catalytic converter to form methanol.

22. The method of claim 15, wherein the enriched gas taken from the fractionator is combined with nitrogen from the coal gasification process to produce liquid ammonia.

23. The method of claim 22, wherein the ammonia is further reacted with carbon dioxide to produce urea.

* * * * *

UNITED STATES PATENT AND TRADEMARK OFFICE

CERTIFICATE OF CORRECTION

PATENT NO. : 6,709,573 B2
DATED : March 23, 2004
INVENTOR(S) : Anthon L. Smith

It is certified that error appears in the above-identified patent and that said Letters Patent is hereby corrected as shown below:

Column 17,
Lines 44 and 45, replace “weight” with -- volume --.

Column 18,
Lines 40 and 41, replace “weight” with -- volume --.

Signed and Sealed this

Sixteenth Day of November, 2004

JON W. DUDAS
*Director of the United States Patent and Trademark Office*